United States Patent [19]

Underwood

[11] Patent Number: 4,800,739

[45] Date of Patent: Jan. 31, 1989

[54] PATTERNING MECHANISM FOR KNITTING MACHINES

[76] Inventor: Kent Underwood, 8100 Flatrock Rd., Stokesdale, N.C. 27357

[21] Appl. No.: 3,208

[22] Filed: Jan. 14, 1987

[51] Int. Cl.[4] ..... D04B 9/10

[52] U.S. Cl. ..... 66/228; 66/218

[58] Field of Search ..... 66/25, 218, 228, 229, 66/232

[56] References Cited

U.S. PATENT DOCUMENTS

| | | | |
|---|---|---|---|
| 2,207,463 | 7/1940 | Lawson et al. | 66/228 X |
| 3,145,548 | 8/1964 | Mishcon | 66/229 |
| 3,166,920 | 1/1965 | Mishcon | 66/228 |
| 3,283,540 | 11/1966 | Levin | 66/228 X |
| 3,313,128 | 4/1967 | Schmidt et al. | 66/229 X |
| 3,894,406 | 7/1975 | Christopoulos | 66/229 X |
| 3,972,208 | 8/1976 | Ferrington | 66/219 |
| 4,041,731 | 8/1977 | York | 66/228 |
| 4,090,377 | 5/1923 | Blank et al. | 66/218 |

FOREIGN PATENT DOCUMENTS

| | | | |
|---|---|---|---|
| 118468 | 7/1930 | Austria | 66/228 |
| 1559099 | 1/1969 | France | 66/218 |
| 1559100 | 1/1969 | France | 66/218 |
| 403791 | 3/1974 | U.S.S.R. | 66/218 |
| 1443887 | 2/1969 | United Kingdom | 66/218 |

*Primary Examiner*—Ronald Feldbaum

*Attorney, Agent, or Firm*—Richard E. Jenkins

[57] ABSTRACT

A patterning device for a circular knitting machine which is particularly adapted for quick style changes. The device comprises a rotor element with a plurality of lobes around the periphery thereof, a drive motor for rotating the rotor element in synchronous rotational movement with the needle cylinder, and a control for actuating the drive motor according to a predetermined program in order to determine which of the lobes will be brought into registry with a respective needle jack to force it out of engagement with the cam and which of the lobes will be caused to miss a respective needle jack and thereby allow the jack to be cammed.

15 Claims, 3 Drawing Sheets

PATTERNING MECHANISM FOR KNITTING MACHINES

TECHNICAL FIELD

The present invention relates to patterning unit for circular knitting machines, and more particularly to a novel and improved patterning mechanism for circular knitting machines which provides for high speed pattern changes.

BACKGROUND ART

Circular hosiery knitting machines have conventionally utilized a separate program drum for each pattern to be knitted on the hosiery machine. The program drum comprises a plurality of pins extending radially outwardly from the drum some of which are typically broken off according to a predetermined plan in order to program the pattern drum for a particular knitted pattern. In the past it has required about eight hours of time in order for an individual to program a single pattern drum for a single hosiery knitting machine. This labor-intensive operation is in direct conflict with the present need of the textile industry for quick pattern changes in order to speedily adapt to ever-changing market styling requirements. The patterning device of the instant invention will allow textile knitting manufacturers the flexibility necessary to make quick styling changes in their product lines in order to meet the styling demands of the marketplace and thereby better compete with foreign textile producers. Thusly, the instant invention will both reduce the labor-intensivity of the domestic textile knitting industry and allow it to promptly respond to marketplace demand for new styles and patterns.

Prior art of interest other than conventional program drums for hosiery knitting machines described above includes U.S. Pat. No. 3,313,128 to Schmidt, et al. which discloses an improved synchronized pattern control for a circular knitting machine of the type utilizing a plurality of knitting stations around the cylinder which incorporate jacks controlled by electromagnetic means. U.S. Pat. No. 4,041,731 to York discloses a patterning unit for a circular knitting machine which rotates at a linear speed corresponding to the rotational speed of the knitting cylinder. Also, U.S. Pat. No. 3,166,920 to Mishcon discloses a patterning mechanism for a circular knitting machine which utilizes an endless jack belt for controlling the knitting pattern. Other patents of possible interest include U.S. Pat. No, 2,207,463 to Lawson, et al., U.S. Pat. No. 3,894,406 to Christopoulos, and U.S. Pat. No. 4,090,377 to Blank, et al.

DISCLOSURE OF THE INVENTION

In accordance with the present invention, applicant broadly contemplates an improved patterning unit for circular knitting machines, particularly hosiery knitting machines, wherein the patterning device is carried by the knitting machine frame adjacent the cam means and is adapted to address the jacks within the needle cylinder to determine which of the jacks and corresponding needles will be cammed and which of the jacks and corresponding needles will not be cammed and thereby determine the pattern knitted by the circular knitting machine. The patterning device comprises a rotor element having a plurality of lobes defined around the periphery thereof, drive means for rotating the rotor element in substantially synchronous rotational movement with the needle cylinder, and control means for actuating the drive means according to a predetermined program in order to determine which of the lobes will be brought into registry with a respective jack in order to force the jack out of engagement with the cam means and which of the lobes will be caused to miss a respective jack and thereby allow the jack to be cammed. The drive means for the rotor element comprises either a servo motor or a digital stepper motor in order to provide the necessary control to the operatively associated rotor element, and the motor may be positioned either in spaced relationship from the rotor element or within the rotor element so that the rotor element rotates around the drive motor.

At least one of the patterning units is utilized in cooperation with each cam means positioned around the periphery of the needle cylinder of the circular knitting machine. The number of patterning devices utilized at each cam means or camming station can vary with the number of lobes provided on each rotor element. For example, if a particular patterning device utilizes a rotor element with spaced lobes around the periphery thereof which address only every third jack on the needle cylinder, then three patterning devices would be utilized at each camming station to assure that a rotor element lobe was available to address, as necessary, each jack traveling by the camming station.

It is therefore the object of the present invention to provide a new improved patterning device for a circular knitting machine which allows for quick pattern changes.

More specifically, it is an object of the present invention to provide an improved patterning device for a hosiery knitting machine which allows for substantially instantaneous pattern change on the knitting machine and to thereby obviate the labor-intensive programming of pattern drums which has been known heretofore.

Still another object of the present invention is to provide a simple and reliable high speed pattern change device for circular knitting machines, particularly for men's and women's hosiery knitting machines, which can be retrofitted to existing machines in order to minimize costs.

Some of the objects of the invention having been stated, other objects will become evident as the description proceeds, when taken in connection with the accompanying drawings.

BEST MODE FOR CARRYING OUT THE INVENTION

Figure 1:
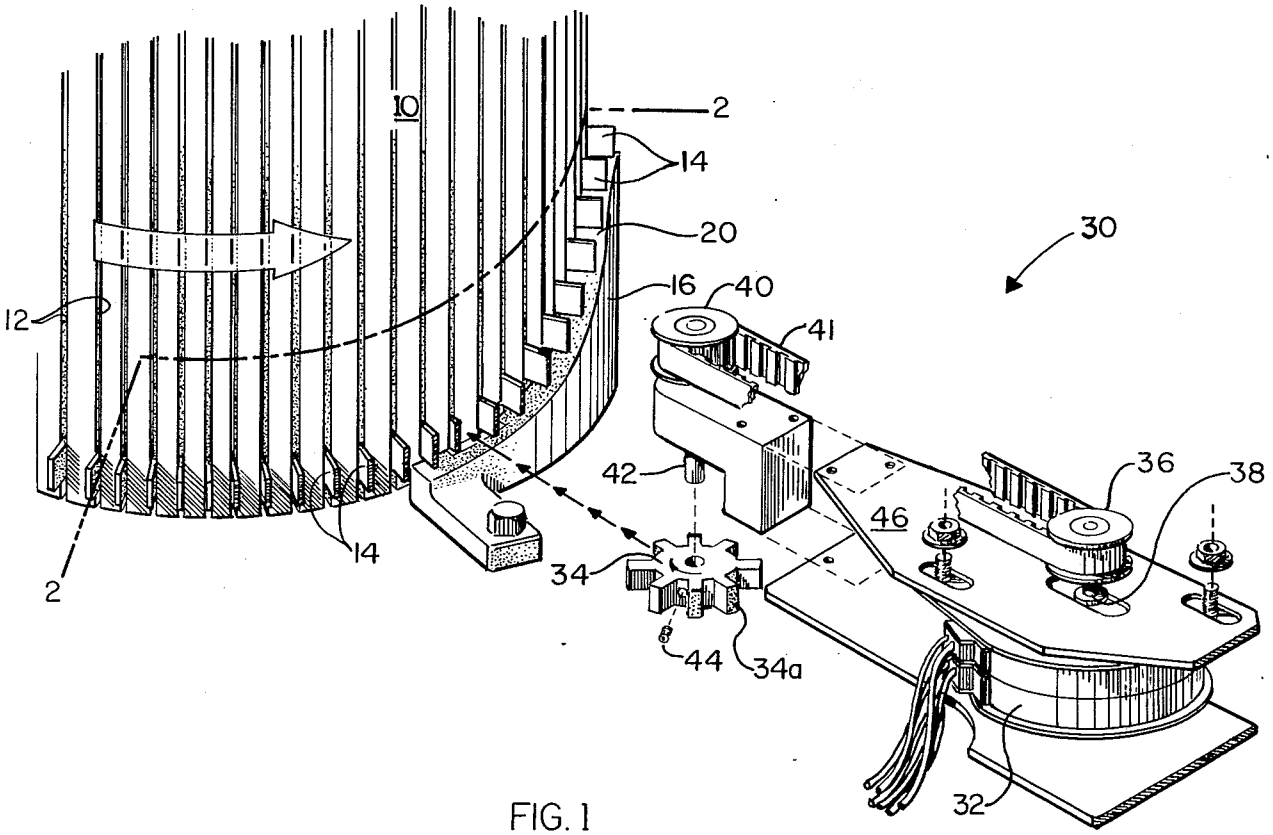
FIG. 1 is an exploded fragmentary perspective view of a patterning device in accordance with the present invention.

Referring now more specifically to the drawings, FIG. 1 illustrates the patterning device of this invention as applied to an otherwise conventional circular hosiery knitting machine of the type utilizing anywhere between about 78 needles to knit men's socks and about 400 needles to knit ladies' hosiery. The parts of the knitting machine which will be necessary for an understanding of the invention include needle cylinder 10 which defines a plurality of vertically extending and parallel slots 12 in the outer periphery thereof. Slots 12 each have slidably positioned at the bottom portion thereof a needle jack (not shown) having a jack butt 14 extending radially outwardly from slot 12. Positioned directly above the jack in each slot 12 is a corresponding needle (not shown) which is pushed upwardly by the jack at a predetermined time as needle cylinder 10 rotates in order to engage a particular yarn according to a knitting pattern.

It should be appreciated that in order to knit a specific pattern in a knitted fabric certain specific knitting needles must be pushed vertically upwardly at a specific point in the rotation of needle cylinder 10. The means for raising a jack and associated needle is provided by one or more fixed cams, cam 16 being illustrated in FIG. 1, provided at spaced locations around the periphery of needle cylinder 10. Whether a jack and associated needle are forced upwardly is dependent upon whether jack butt 14 is pressed radially inwardly so as to traverse slot 18 defined by the back surface of cam 16 and extending generally in the normal path of traverse of jack butt 14 or whether jack butt 14 is not depressed and thus allowed to engage and ride over the camming surface 20 of cam 16 (see FIG. 3). The jack which pushes an associated needle upwardly to engage a specific pattern yarn is conventional and is essentially an intermediate cam being placed between fixed cam 16 and the knitting needle associated with the jack so that is not necessary to push directly on the needle in order to urge it upwardly.

In the instant invention a patterning device, generally designated 30, is provided to determine which of the successive jack butts 14 will be pressed inwardly in order not to be cammed by cam 16 and which jack butts will be missed and thereby allowed to be cammed by cam 16 in order to urge the needle associated with the jack upwardly to engage a particular pattern yarn. Patterning device 30 serves to replace a labor-intensive pin-type pattern drum system which has necessitated breaking pins off a new drum according to a predetermined pattern in order for the machine to knit a new style. Pattern device 30 of the instant invention allows for substantially instantaneous pattern changes and therefore provides for substantially reduced labor costs and the ability to quickly accommodate changes in styling demands from the marketplace.

Although the quick-change patterning device should be applicable to many circular knitting machines in order to provide the ability to make quick pattern changes, it is primarily intended, as noted above, to be used in conjunction with conventional circular hosiery machines of the type used to knit men's and women's hosiery. It is contemplated that the novel patterning device can be retrofitted at relatively low cost to existing machinery in order to allow knitters to respond more quickly to marketplace style changes.

In order to better understand the instant invention, patterning device 30 will be fully explained with particular reference to FIGS. 1 and 2. As best seen in FIG. 1, pattern device 30 includes an electrical motor 32 which is most suitably either a stepper motor of the type utilizing about 200 steps per revolution (for example, a PMI brand type U6M4 or HURST Model No. 3803-001) or a servo motor (for example, MAGNETIC TECHNOLOGY Model Nos. HI937D-2361, 1500K-125 and 1500L-053). Motor 32 is used to drive rotor cam 34. Although many mechanical linkages are feasible, FIG. 1 illustrates motor 32 driving rotor cam 34 by means of a pulley system comprising pulley 36 which fixedly engages shaft 38 of motor 32, and pulley 40 which fixedly engages shaft 42 to which rotor cam 34 is fixedly secured with set screw 44. Pulley 36 is operatively connected to pulley 40 by belt 41. The aforementioned components of patterning device 30 are secured to frame 46 of conventional construction which could vary as a matter of design choice.

Although patterning device 30 utilizes motor 32 in spaced-apart relationship from driven rotor cam 34, applicant contemplates that a motor could be provided within a rotor for purposes of reduced space requirements. Most suitably, the shaft of the servo or digital stepper motor would be fixed with the rotor rotating relative thereto. More specifically, applicant contemplates that the fixed shaft would have field coils secured thereto and the permanent magnets of the motor would be secured to the inner surface of the rotor cam. Therefore, the nodes or cams on the rotor cam would be integral with the rotating armature of the motor and cam assembly. This particular configuration, while not shown in the drawings, can be understood and appreciated to require less space than patterning device 30 shown in FIG. 1.

Figure 2A:
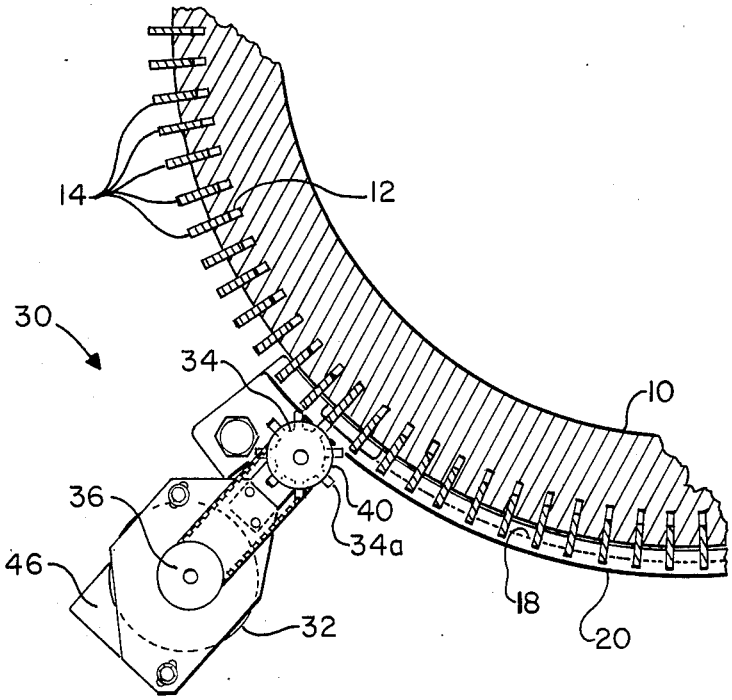
FIG. 2A is a fragmentary plan view of the patterning device of FIG. 1 with a lobe of the rotor element pushing a jack inwardly so that it will not be cammed.
Figure 2B:
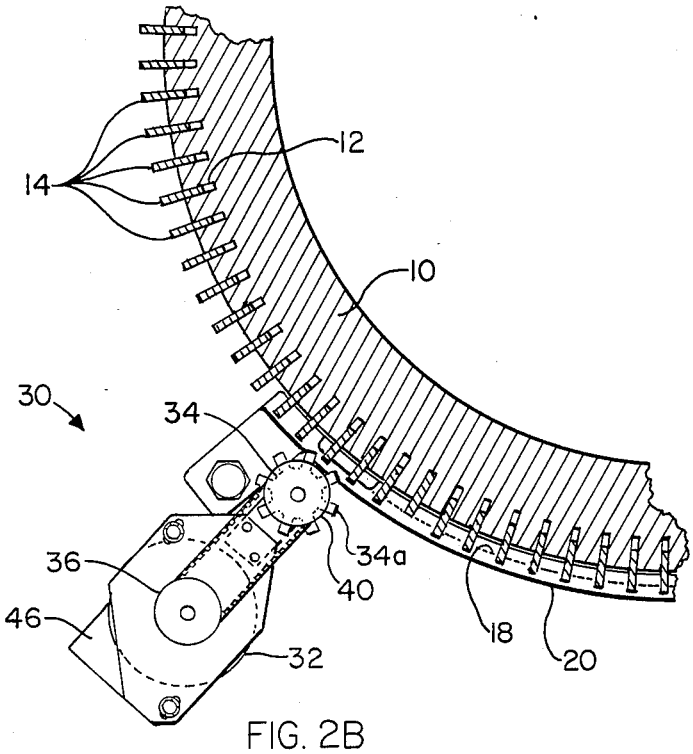
FIG. 2B is a fragmentary plan view of the patterning device of FIG. 1 with a lobe of the rotor element missing a jack so that it will be cammed.

With reference now to FIGS. 2A and 2B, it can be seen that the preferred embodiment of the novel patterning device contemplates that rotor cam 34 will have a plurality of lobes or cams defined around the periphery thereof, most suitably about 10 to 15 lobes. Lobes **34*a* of rotor cam 34 are constructed so that when patterning device 30 is secured to the frame of the knitting machine adjacent cam 16, lobes 34*a* will address in seriatim each jack butt 14 as rotor cam 34 is driven at a synchronous speed with needle cylinder 10 by motor 32. Therefore, as best seen in FIG. 2A, lobes 34*a* will normally address in seriatim jack butts 14 and push them inwardly into their respective slots 12 within needle cylinder 10. As each jack butt 14 is pushed inwardly into slot 12 by a lobe 34*a* of rotor cam 34 it will be forced to enter slot 18 (defined on the back side of cam 16) so as to continue its lateral movement and not be cammed upwardly. If it is desired to allow a particular jack butt 14 to be cammed by cam 16, motor 32 will stop rotor cam 34 for about one-half of the distance between lobes 34*a* and thereby cause a lobe 34*a* which would normally have addressed a corresponding jack butt 14 to be positioned between two jack butts as can be seen in FIG. 2B. Lobe 34*a* therefore misses the designated jack butt 14, and jack butt 14 will consequently ride up cam surface 20 of cam 16 and force the associated needle upwardly according to the pattern design. Rotor cam 34 may continue to rotate at a synchronous speed with needle cylinder 10 if it is desired that additional jack butts 14 be cammed. When it is desired that a jack butt not be cammed, motor 32 will again stop rotor cam 34 for one-half of the distance between lobes 34*a* in order to again allow lobes 34***a* to address jack butts 14 as rotor cam 34 rotates at synchronous speed with needle cylinder 10.

To summarize for clarity of understanding, FIG. 2A depicts a lobe of rotor cam 34 pushing a jack butt 14 inwardly so that it will enter slot 18 defined by the back surface of cam 16 (see FIG. 3) and not be cammed whereas FIG. 2B depicts a lobe of rotor cam 34 missing a designated jack butt 14 so that the jack butt and associated needle will be cammed by cam 16. Although FIGS. 1–2 depict a patterning device utilizing a rotor cam constructed so that a successive lobe 34*a* is available to address each successive jack butt 14 in needle cylinder 10, other constructions of rotor cam 34 are possible. For example, rotor cam 34 may be constructed such that successive lobes 34*a* address only every third jack butt 14 if patterning device 30 is utilized on a hosiery machine having a very large number of needles in needle cylinder 10. If rotor cam 34 only addresses every third jack butt 14, applicant contemplates that three of the patterning devices could be utilized at each cam 16 in such a fashion that each jack butt 14 would be assured of being addressed by a lobe of a rotor cam according to a sequence determined by a pattern style. The particular arrangement of the three patterning devices would be a matter of design choice so long as each successive jack butt 14 in needle cylinder 10 is assured of being addressed by a lobe which would either push it inwardly so that it would enter slot 18 and not be cammed or miss it and allow it to be cammed. Moreover, applicant's invention contemplates that other arrangements of the novel patterning device on conventional circular knitting machines may be possible. A common feature between all contemplated configurations would be the use of a rotor cam rotated at a synchronous speed with the needle cylinder by a servo or stepper motor.

Figure 3:
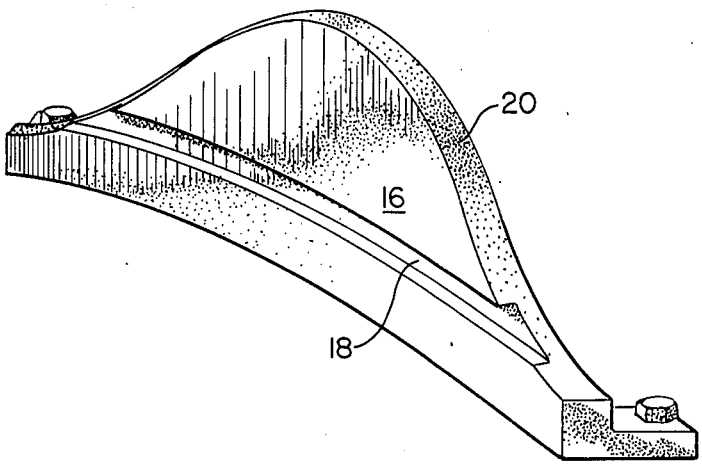
FIG. 3 is an enlarged perspective view of a typical cam used on a circular knitting machine illustrating the jack pathway thereover for camming of the jack and therebehind when the jack is not to be cammed.

Although not shown in FIGS. 1–3, motor 32 is controlled by any suitable means which is able to allow the motor to drive rotor cam 34 so that each lobe 34A will address a jack butt 14 and either press it inwardly or miss it according to a predetermined sequence which is controlled by the knitting pattern which is to be knitted. A preferred control for motor 32 would be a computer programmed according to the fabric style to be knitted and electrically connected to a driver board to provide electrical impulses to motor 32 according to digital impulses from the computer. Output from the driver board would be in the form of digital pulses for a stepper motor or coded polarized pattern electronic information to a servo motor. As noted above, although a computer and driver board are suitable to actuate motor 32 according a sequence determined by a pattern style which is to be knitted, other control means to actuate motor 32 are contemplated by the instant invention.

It will thus be seen that there has been described above a new and improved patterning device for circular knitting machines which is particularly advantageous in that it allows for quick pattern changes and may be used in conjunction with new or older knitting machines.

It will thus be understood that various details of the invention may be changed without departing from the scope of the invention. Furthermore, the foregoing description is for the purpose of illustration only, and not for the purpose of limitation—the invention being defined by the claims.

What is claimed is:

1. In a circular knitting machine having a frame, a rotatable needle cylinder in which a plurality of needle jacks are independently constrained for relative vertical movement, cam means being fixed laterally adjacent to the periphery of said rotatable needle cylinder for lifting certain selected needle jacks as said jacks travel by said cam means, a patterning device carried by said frame for addressing said jacks and determining which of said jacks will be cammed and which of said jacks will not be cammed and thereby determining the pattern knitted by said machine, said patterning device comprising a plurality of lobes defined about the periphery of a rotor element adjacent said needle cylinder, drive means for rotating said rotor element in substantially synchronous rotational movement with said needle cylinder comprising a drive motor positioned radially outwardly from said needle cylinder and said rotor element, and a force transmission means operatively connected between said drive rotor and said motor element and control means for actuating said drive means according to a predetermined program in order to determine which of said lobes will be brought into registry with a respective jack in order to force said jack out of engagement with said cam means and which of said lobes will be caused to miss a respective jack and thereby allow said jack to be cammed, said rotor element having a diameter such that the peripheral surface speed of said rotor element is no greater than the peripheral surface speed of said needle cylinder when successive lobes thereof are successively engaging successive jacks of said needle cylinder.

2. In a circular knitting machine according to claim 1 wherein said plurality of lobes define a rotor cam.

3. In a circular knitting machine according to claim 2 wherein said rotor cam comprises about 10 to 15 lobes.

4. In a circular knitting machine according to claim 1 wherein said drive means for rotating said rotor element comprises a servo motor.

5. In a circular knitting machine according to claim 1 wherein said drive means for rotating said rotor element comprises a digital stepper motor.

6. In a circular knitting machine according to claim 5 wherein said stepper motor has about 200 steps per revolution.

7. In a circular knitting machine according to claim 1 wherein said needle cylinder comprises about 78–400 needles and said knitting machine comprises a hosiery knitting machine.

8. In a circular knitting machine according to claim 1 including a plurality of said patterning devices and a plurality of cam means wherein at least one of said patterning devices is operatively associated with each of said plurality of cam means.

9. In a circular knitting machine having a frame, a rotatable needle cylinder in which a plurality of needle jacks are independently constrained for relative vertical movement, cam means being fixed laterally adjacent to the periphery of said rotatable needle cylinder for lifting certain selected needle jacks as said jacks travel by said cam means, a patterning device carried by said frame for addressing said jacks and determining which of said jacks will be cammed and which of said jacks will not be cammed and thereby determining the pattern knitted by said machine, said pattern device comprising a rotor cam adjacent said needle cylinder, an electrical motor for driving said rotor cam in substantially synchronous rotational movement with said needle cylinder and being positioned radially outwardly from said needle cylinder and said rotor cam, a force transmission means operatively connected between said electrical motor and said rotor cam, a control means for actuating said motor according to a predetermined program in order to cause selective engagement of said jacks by said rotor cam wherein engagement of a jack will force said jack to travel behind said cam means and lack of engagement of a jack by said rotor cam will allow said jack to be cammed, said rotor cam having a diameter such that the peripheral surface speed of said rotor element is no greater than the peripheral surface speed of said needle cylinder when successive lobes thereof are successively engaging successive jacks of said needle cylinder.

10. In a circular knitting machine according to claim 9 wherein said electrical drive motor comprises a servo motor.

11. In a circular knitting machine according to claim 9 wherein said electrical drive motor comprises a digital stepper motor.

12. In a circular knitting machine according to claim 11 wherein said stepper motor has about 200 steps per revolution.

13. In a circular knitting machine according to claim 9 wherein said needle cylinder comprises about 78–400 needles and said knitting machine comprises a hosiery knitting machine.

14. In a circular knitting machine according to claim 9 including a plurality of patterning devices and a plurality of cam means wherein at least one of said patterning devices is operatively associated with each of said plurality of cam means.

15. In a circular knitting machine according to claim 14 wherein three of said patterning devices are operatively associated with each of said plurality of cam means.

* * * * *